US007819546B1

(12) United States Patent
Kazmerowski et al.

(10) Patent No.: US 7,819,546 B1
(45) Date of Patent: Oct. 26, 2010

(54) ADJUSTABLE FLASHLIGHT AND ASSOCIATED METHOD

(76) Inventors: Karen Kazmerowski, 208 Beacon Hill Rd., Califon, NJ (US) 07830; Dennis Kazmerowski, 208 Beacon Hill Rd., Califon, NJ (US) 07830; Ashley Kazmerowski, 208 Beacon Hill Rd., Califon, NJ (US) 07830

( * ) Notice: Subject to any disclaimer, the term of this patent is extended or adjusted under 35 U.S.C. 154(b) by 267 days.

(21) Appl. No.: 12/077,909

(22) Filed: Mar. 24, 2008

(51) Int. Cl.
*F21L 4/02* (2006.01)

(52) U.S. Cl. ..... 362/184; 362/188; 362/197

(58) Field of Classification Search ..... 362/20, 362/183, 184, 187, 188, 194, 195, 200–206, 362/208, 249.01–249.03, 249.05, 254, 276, 362/398

See application file for complete search history.

(56) References Cited

U.S. PATENT DOCUMENTS 2,538,332 A 1/1951 Schaefer
2,959,667 A * 11/1960 Cheng ..... 362/184
2,987,718 A * 6/1961 Davis ..... 340/321
2,991,349 A * 7/1961 Garland ..... 362/194
3,003,057 A * 10/1961 Cheng ..... 362/184
3,030,497 A * 4/1962 Cheng ..... 362/184
3,535,506 A * 10/1970 Bacevius et al. ..... 362/184
3,944,805 A * 3/1976 Moore ..... 362/194
4,218,637 A * 8/1980 Zelina, Jr. ..... 315/313
4,907,769 A * 3/1990 Hunley et al. ..... 248/185.1
4,926,299 A * 5/1990 Gilson ..... 362/184
5,217,297 A * 6/1993 Yuen ..... 362/184
5,428,514 A * 6/1995 Fink, Jr. ..... 362/183
5,510,963 A * 4/1996 Bamber et al. ..... 362/190
5,577,697 A * 11/1996 Accordino ..... 248/206.5
6,206,541 B1 3/2001 Landamia
6,641,279 B1 11/2003 Williams

* cited by examiner

*Primary Examiner*—Hargobind S Sawhney

(57) ABSTRACT

A bi-directional flashlight for providing improved illumination includes a central body with a handle. The device further includes a first light-emitting section permanently attached directly to the first end of the body and facing a first direction away therefrom. Such a first light-emitting section further includes a mechanism for linearly reciprocating the light bulb along a first linear path such that the light bulb selectively oscillates back and forth along a fourth direction based upon a user input. The device further includes a second light-emitting section removably and selectively attached to the second end of the central body and the handle such that the second light-emitting section selectively faces second and third directions defined parallel and perpendicular to the first direction respectively. The device further includes a holding implement and a mechanism for selectively biasing the second light-emitting section along a second linear path.

17 Claims, 4 Drawing Sheets

ADJUSTABLE FLASHLIGHT AND ASSOCIATED METHOD

CROSS REFERENCE TO RELATED APPLICATIONS

This application claims the benefit of U.S. patent application Ser. No. 11/427,117, filed Jun. 28, 2006, which claims the benefit of U.S. Provisional Application No. 60/694,584, filed Jun. 29, 2005, now abandoned. The entire disclosures of U.S. patent application Ser. No. 11/427,117 and U.S. Provisional Application No. 60/694,584 are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to flashlight devices and, more particularly, to a bi-directional flashlight for providing improved illumination.

2. Prior Art

The standard flashlight has found a well-deserved place in toolboxes everywhere. It is the perfect tool for providing light almost anywhere. It can be used to provide supplemental light in dimly lit locations, and provide the sole source of light in locations without any light or during a power failure. One common use for a flashlight is to light a path while walking in-line with someone else such as in a tunnel or down a path.

During such use, the lead person swings the beam side-to-side to light the way. Unfortunately, if those following do not have their own flashlight, they may stumble in the dark. Additionally, if the lead person gets too far ahead, those following may have difficulty in locating them, since the light beam is aimed in the other direction. Obviously, it would be advantageous to provide a means by which the use of a single flashlight can simultaneously illuminate two separate locations.

Accordingly, a need remains for a bi-directional flashlight in order to overcome the above-noted shortcomings. The present invention satisfies such a need by providing a device that is convenient and easy to use, is durable yet lightweight in design, is versatile in its applications, and provides improved illuminating capabilities over conventional flashlight devices. Such a bi-directional flashlight can easily and comfortably be held in a person hand for extended periods of time. The dual light emitting sources, advantageously allows a user to simultaneously or independently illuminate an area in front of, and behind them, respectively. This allows for any person positioned behind the device operator to more easily maintain a line of sight of the flashlight operator.

BRIEF SUMMARY OF THE INVENTION

In view of the foregoing background, it is therefore an object of the present invention to provide a bi-directional flashlight. These and other objects, features, and advantages of the invention are provided by a bidirectional flashlight for providing improved illumination.

A bi-directional flashlight for providing improved illumination includes a central body with a handle attached thereto and axially opposed first and second ends. The device further includes a first light-emitting section permanently attached directly to the first end of the body and effectively facing a first direction away therefrom. Such a first light-emitting section further includes a mechanism for linearly reciprocating the light bulb along a first linear path such that the light bulb selectively oscillates back and forth along a fourth direction based upon a user input.

Such a linearly reciprocating mechanism includes an elongated rectilinear shaft conveniently passing through the casing with axially opposed ends disposed exterior thereof. A plurality of turn knobs is statically coupled to the shaft ends respectively, and a drum is statically coupled to the shaft and medially situated between the knobs. Such a drum has a curvilinear groove formed therein that travels back and forth along an outer surface of the drum. A plurality of guide tracks is formed within an interior of the casing, and a U-shaped arm brace has a plurality of ends slidably seated within the guide tracks in such a manner that the arm brace is linearly reciprocated along the fourth direction wherein the fourth direction is oriented perpendicular to the second direction.

The mechanism further includes a plurality of brackets statically coupled to the arm brace and the light bulb respectively, and a cam rod fixedly anchored to the arm brace and dynamically positioned within the groove such that the cam rod naturally glides along the curvilinear groove and thereby causes the arm brace and the light bulb to linearly reciprocate in sync along the fourth direction when at least one of the knobs are rotated.

The device further includes a second light-emitting section removably and selectively advantageously attached to the second end of the central body and the handle such that the second light-emitting section selectively faces second and third directions defined parallel and perpendicular to the first direction respectively. Such a second light-emitting section includes a casing and a light bulb positioned within the casing.

The device further includes a holding implement with a magnetic bottom surface removably attachable to a support surface. Such a holding implement further has an arcuate top surface for effectively receiving and maintaining the central body at a substantially stable position. An adjustable strap is included with a pair of buckles formed at opposed ends thereof for adjusting a length of the strap. Such a strap is removably attached to the second light-emitting section. Each of the first and second light-emitting sections has respective switches that are independently toggled between operable and inoperable positions respectively.

The device further includes a mechanism for selectively biasing the second light-emitting section along a second linear path registered parallel to a longitudinal length of the handle such that the second light-emitting section linearly conveniently oscillates back and forth along a fifth direction based upon a user input. Such a selectively biasing mechanism includes a dial seated exterior of the casing with a shaft connected thereto. Such a shaft is disposed within the casing and has a crank finger protruding outwardly therefrom. A pivotal drive arm has a linear slot formed at one end thereof and further has a toothed arcuate face formed at an opposing end thereof respectively, and a mobile plate is seated within the handle and has a receptacle positioned at a top surface thereof.

The selectively biasing mechanism further includes a toothed beam statically anchored to a bottom surface of the plate and advantageously in direct engagement with the toothed arcuate face respectively. A protective cap is pivotally coupled to the handle and adjustably positioned over the receptacle for shielding the receptacle from undesirable foreign debris, and the casing is threadably seated within the receptacle and protrudes outwardly from the handle. The cam finger travels back and forth along the slot when the dial is rotated such that the toothed arcuate face selectively engages the toothed beam and thereby linearly reciprocates the plate and the second light-emitting section along the fifth direction. The fifth direction is registered perpendicular to the fourth direction.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
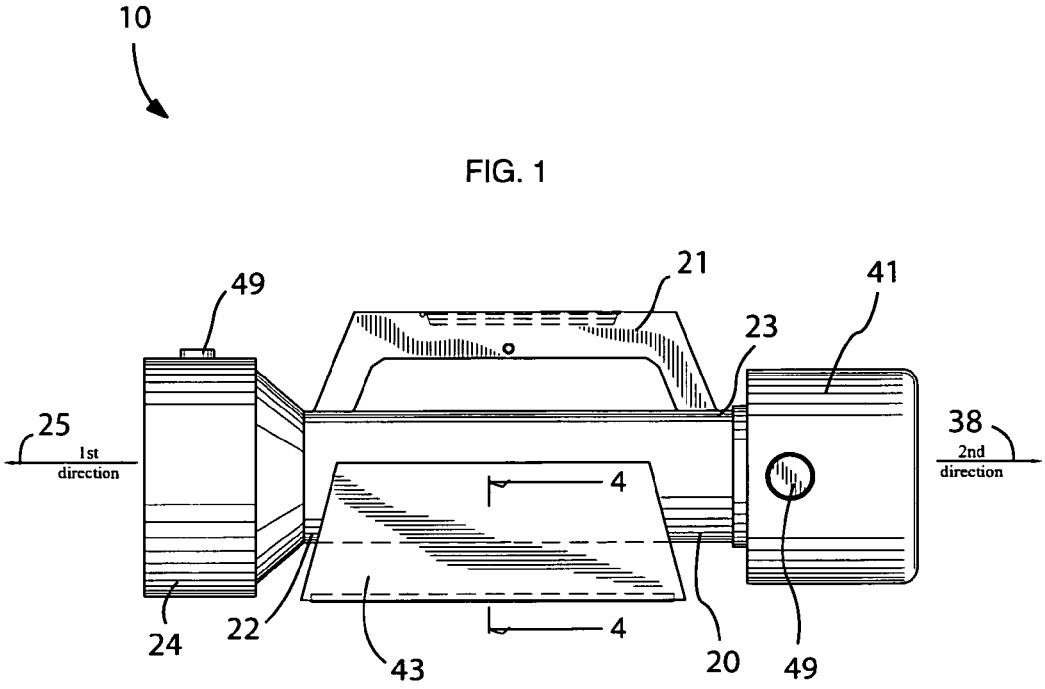
FIG. 1 is a side elevational view of a bi-directional flashlight, in accordance with the present invention.
Figure 2:
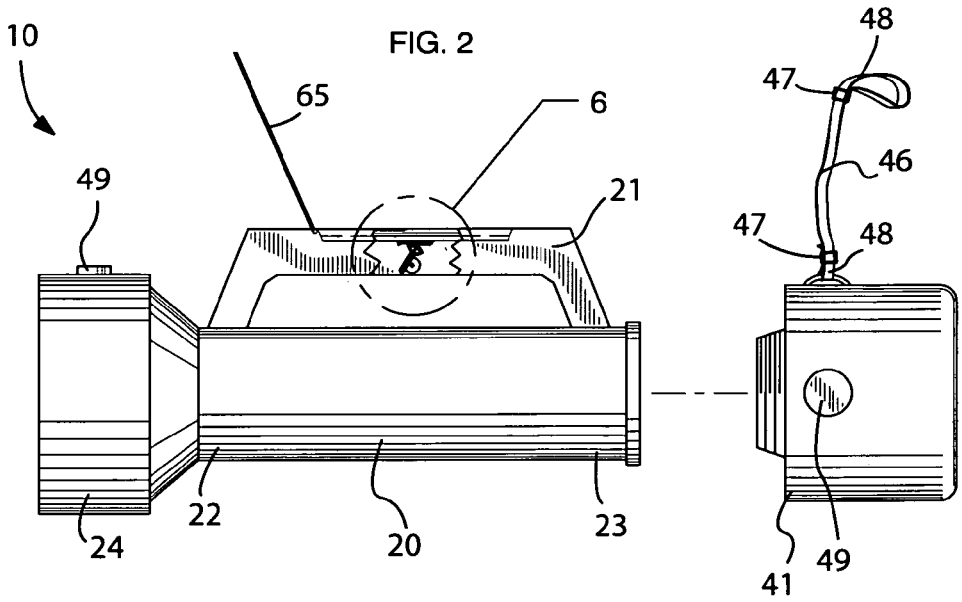
FIG. 2 is side elevational view of a bi-directional flashlight, showing the removable feature of the second light-emitting section, in accordance with the present invention.
Figure 3:
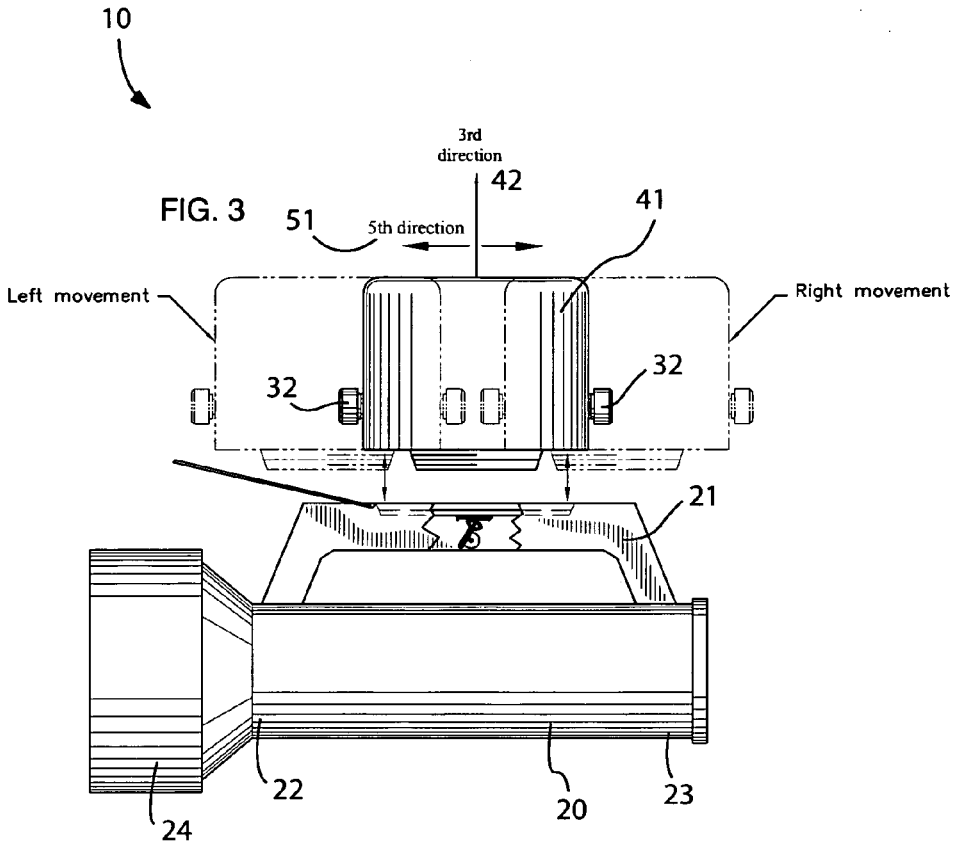
FIG. 3 is a side elevational view of a bi-directional flashlight, showing the placement of the second light-emitting section at the third direction, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-9 by the reference numeral 10 and is intended to protect a bi-directional flashlight. It should be understood that the apparatus 10 may be used to improve many different types of lights and should not be limited to improving only those types of lights mentioned herein.

Referring initially to FIGS. 1, 2, 3, 4, 7, 8 and 9, a bi-directional flashlight 10 for providing improved illumination includes a central body 20 with a handle 21 attached thereto and axially opposed first and second ends 22, 23. The device 10 further includes a first light-emitting section 24 permanently attached directly, without the use of intervening elements, to the first end 22 of the body 20 and facing a first direction 25 away therefrom. Such a first light-emitting section 24 further includes a mechanism 26 for linearly reciprocating a light bulb 27 along a first linear path which is essential such that the light bulb 27 selectively oscillates back and forth along a fourth direction 28 based upon a user input. The first light-emitting section 24 can be used like a standard flashlight when only standard lighting is required by a user.

Such a linearly reciprocating mechanism 26 includes an elongated rectilinear shaft 29 passing through a casing 30 with axially opposed ends 31 disposed exterior thereof. A plurality of turn knobs 32 is statically coupled to the shaft ends 31 respectively, and a drum 33 is statically coupled to the shaft 29 and medially situated between the knobs 32. Such a drum 33 has a curvilinear groove 34 formed therein that travels back and forth along an outer surface of the drum 33. A plurality of guide tracks 35 is formed within an interior of the casing 30, and a U-shaped arm brace 36 has a plurality of ends 37 slidably seated within the guide tracks 35 in such a manner that the arm brace 36 is linearly reciprocated along the fourth direction 28 wherein the fourth direction 28 is oriented perpendicular to a second direction 38.

The mechanism 26 further includes a plurality of brackets 39 statically coupled to the arm brace 36 and the light bulb 27 respectively, and a cam rod 40 fixedly anchored to the arm brace 36 and dynamically positioned within the groove 34 which is important such that the cam rod 40 naturally glides along the curvilinear groove 34 and thereby causes the arm brace 36 and the light bulb 27 to linearly reciprocate in sync along the fourth direction 28 when at least one of the knobs 32 are rotated. The linearly reciprocating mechanism 26 enables a user to adjust the light stream of the first light-emitting section as may be required by the user.

Referring to FIGS. 1, 2, 3, 7 and 9, the device 10 further includes a second light-emitting section 41 removably and selectively attached to the second end 23 of the central body 20 and the handle 21 which is vital such that the second light-emitting section 41 selectively faces second and third directions 38, 42 defined parallel and perpendicular to the first direction 25 respectively. Such a second light-emitting section 41 includes the casing 30 and the light bulb 27 positioned within the casing 30.

Figure 4:
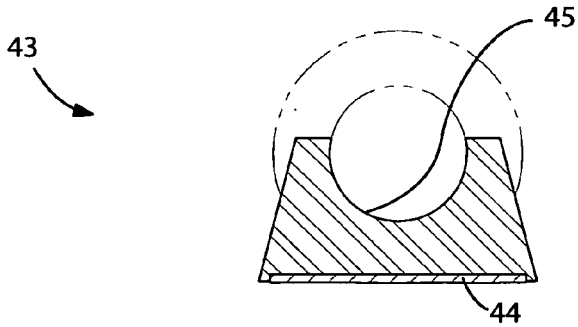
FIG. 4 is a cross sectional view of the holding implement, taken along line 4-4, as seen in FIG. 1.
Figure 5:
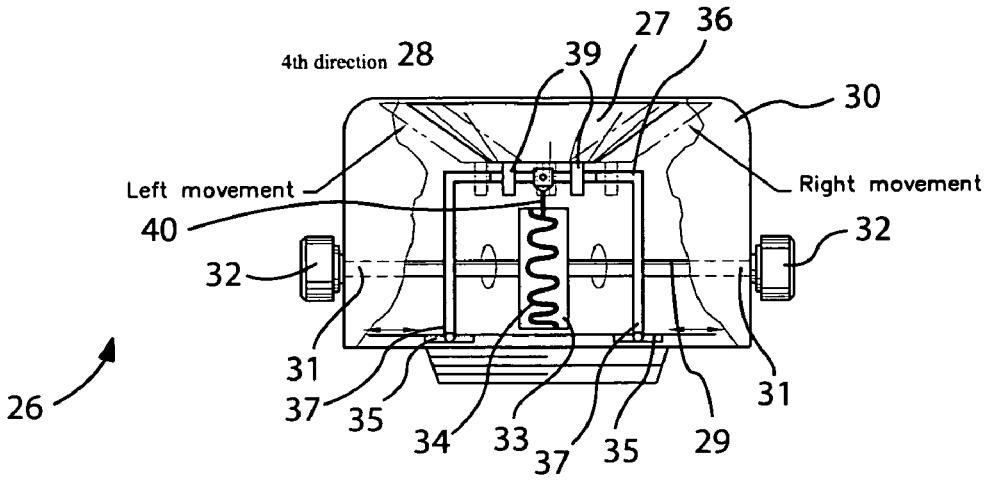
FIG. 5 is a view of the linearly reciprocating mechanism, in accordance with the present invention.

Referring to FIG. 4, the device 10 further includes a holding implement 43 with a magnetic bottom surface 44 removably attachable to a support surface. Such a holding implement 43 further has an arcuate top surface 45 for receiving and maintaining the central body 20 at a substantially stable position. An adjustable strap 46 is included with a pair of buckles 47 formed at opposed ends 48 thereof for adjusting a length of the strap 46. Such a strap 46 is removably attached to the second light-emitting section 41. Each of the first and second light-emitting sections 24, 41 has respective switches 49 that are independently toggled between operable and inoperable positions respectively. The holding implement 43 enables a user to temporarily affix the device 10 to a magnetic surface, thereby providing a user with hands-free lighting.

Figure 6:
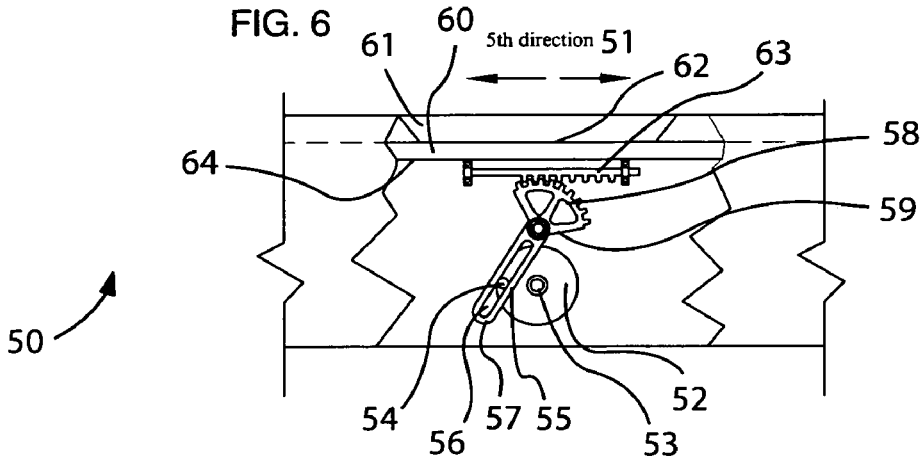
FIG. 6 is a view of the selectively biasing mechanism, in accordance with the present invention.
Figure 7:
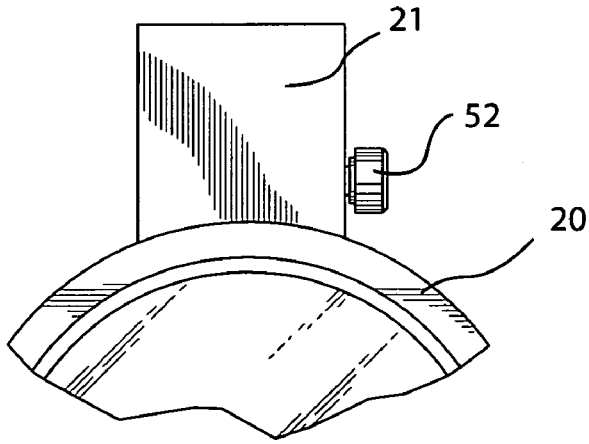
FIG. 7 is a rear elevational view of the central body, in accordance with the present invention.
Figure 8:
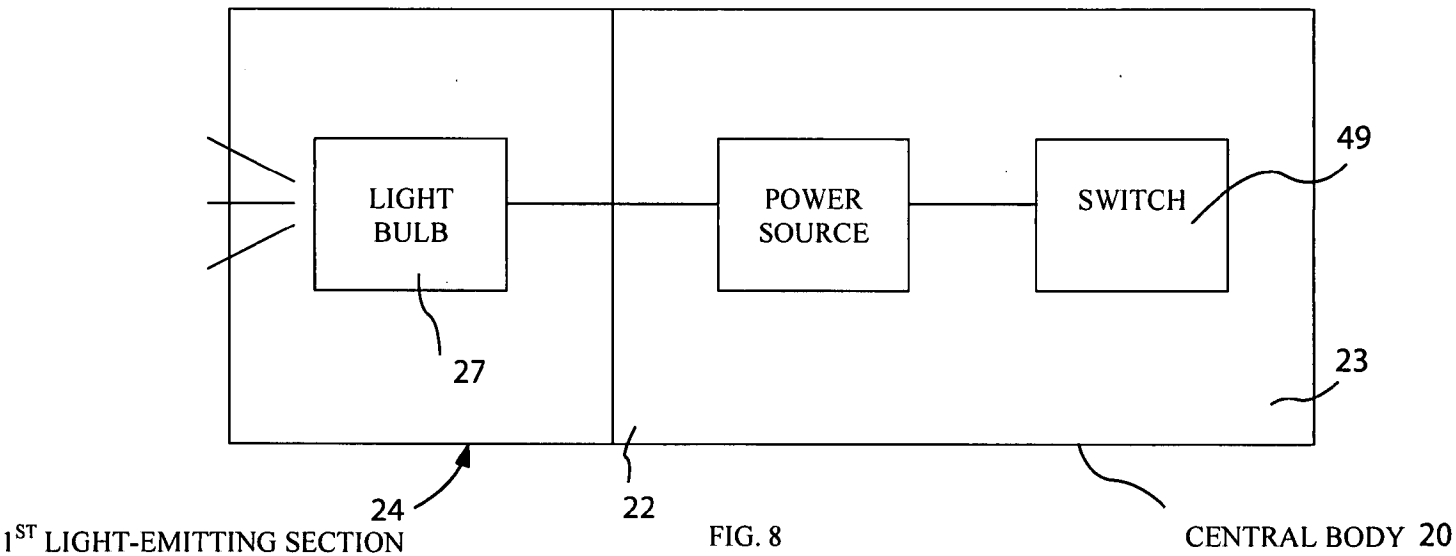
FIG. 8 is a schematic block diagram of first light-emitting section and central body, in accordance with the present invention.
Figure 9:
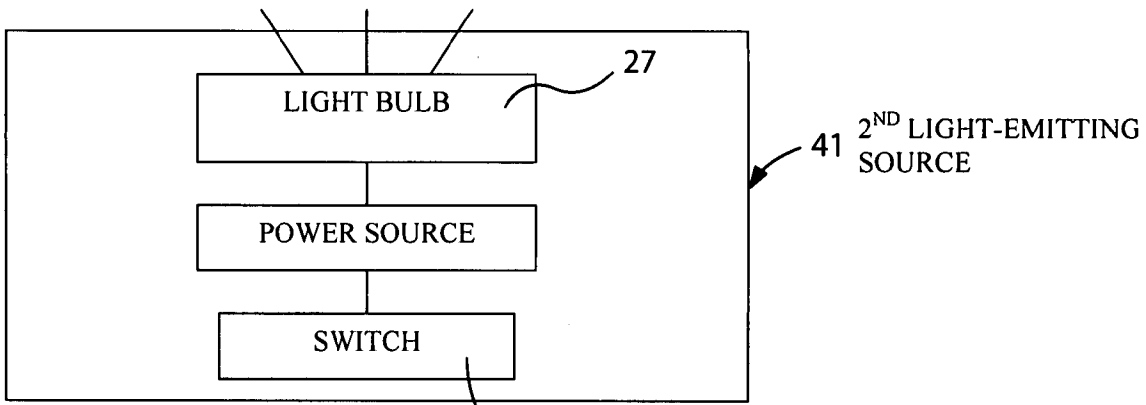
FIG. 9 is a schematic block diagram of the second light-emitting section, in accordance with the present invention.

Referring to FIGS. 6 and 7, the device 10 further includes a mechanism 50 for selectively biasing the second light-emitting section along a second linear path registered parallel to a longitudinal length of the handle 21 which is crucial such that the second light-emitting section 41 linearly oscillates back and forth along a fifth direction 51 based upon a user input. Such a selectively biasing mechanism 50 includes a dial 52 seated exterior of the casing 30 with a shaft 53 connected thereto. Such a shaft 53 is disposed within the casing 30 and has a crank finger 54 protruding outwardly therefrom. A pivotal drive arm 55 has a linear slot 56 formed at one end 57 thereof and further has a toothed arcuate face 58 formed at an opposing end 59 thereof respectively, and a mobile plate 60 is seated within the handle 21 and has a receptacle 61 positioned at a top surface 62 thereof.

The selectively biasing mechanism further 50 includes a toothed beam 63 statically anchored to a bottom surface 64 of the plate 60 and in direct engagement with the toothed arcuate face 58 respectively. A protective cap 65 is pivotally coupled to the handle 21 and adjustably positioned over the receptacle 61 for shielding the receptacle 61 from undesirable foreign debris, and the casing 30 is threadably seated within the receptacle 61 and protrudes outwardly from the handle 21. The cam finger 40 travels back and forth along the slot 56 when the dial 52 is rotated which is essential such that the toothed arcuate face 58 selectively engages the toothed beam 63 and thereby linearly reciprocates the plate 60 and the second light-emitting section 41 along the fifth direction. The fifth direction is registered perpendicular to the fourth direction.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A bi-directional flashlight for providing improved illumination, said bi-directional flashlight comprising:

a central body having a handle attached thereto and further having axially opposed first and second ends;

a first light-emitting section permanently attached directly to said first end of said body and facing a first direction away therefrom; and a second light-emitting section removably and selectively attached to said second end of said central body and said handle such that said second light-emitting section selectively faces second and third directions defined parallel and perpendicular to said first direction respectively, said second light-emitting section including a casing and a light bulb positioned within said casing;

wherein said each of said first and second light-emitting sections have respective switches that are independently toggled between operable and inoperable positions respectively;

wherein said second light-emitting section further comprises: means for linearly reciprocating said light bulb along a first linear path such that said light bulb selectively oscillates back and forth along a fourth direction based upon a user input wherein said fourth direction is one of substantially parallel or substantially perpendicular to the said second direction.

2. The bi-directional flashlight of claim 1, wherein said linearly reciprocating means comprises:

an elongated rectilinear shaft passing through said casing and having axially opposed ends disposed exterior thereof;

a plurality of turn knobs statically coupled to said shaft ends respectively;

a drum statically coupled to said shaft and medially situated between said knobs, said drum having a curvilinear groove formed therein that travels back and forth along an outer surface of said drum;

a plurality of guide tracks formed within an interior of said casing;

a U-shaped arm brace having a plurality of ends slidably seated within said guide tracks in such a manner that said arm brace is linearly reciprocated along said fourth direction;

a plurality of brackets statically coupled to said arm brace and said light bulb respectively; and a cam rod fixedly anchored to said arm brace and dynamically positioned within said groove such that said cam rod naturally glides along said curvilinear groove and thereby causes said arm brace and said light bulb to linearly reciprocate in sync along said fourth direction when at least one of said knobs are rotated.

3. The bi-directional flashlight of claim 2, wherein said fourth direction is oriented perpendicular to said second direction.

4. The bi-directional flashlight of claim 1, further comprising:

means for selectively biasing said second light-emitting section along a second linear path registered parallel to a longitudinal length of said handle such that said second light-emitting section linearly oscillates back and forth along a fifth direction based upon a user input.

5. The bi-directional flashlight of claim 4, wherein said selectively biasing means comprises:

a dial seated exterior of said casing and having a shaft connected thereto, said shaft being disposed within said casing and having a crank finger protruding outwardly therefrom;

a pivotal drive arm having a linear slot formed at one end thereof and further having a toothed arcuate face formed at an opposing end thereof respectively;

a mobile plate seated within said handle and having a receptacle positioned at a top surface thereof;

a toothed beam statically anchored to a bottom surface of said plate and being in direct engagement with said toothed arcuate face respectively; and a protective cap pivotally coupled to said handle and adjustably positioned over said receptacle for shielding said receptacle from undesirable foreign debris;

said casing being threadably seated within said receptacle and protruding outwardly from said handle;

wherein said cam finger travels back and forth along said slot when said dial is rotated such that said toothed arcuate face selectively engages said toothed beam and thereby linearly reciprocates said plate and said second light-emitting section along said fifth direction.

6. The bi-directional flashlight of claim 5, wherein said fifth direction is registered perpendicular to said fourth direction.

7. A bi-directional flashlight for providing improved illumination, said bi-directional flashlight comprising:

a central body having a handle attached thereto and further having axially opposed first and second ends;

a first light-emitting section permanently attached directly to said first end of said body and facing a first direction away therefrom;

a second light-emitting section removably and selectively attached to said second end of said central body and said handle such that said second light-emitting section selectively faces second and third directions defined parallel and perpendicular to said first direction respectively, said second light-emitting section including a casing and a light bulb positioned within said casing;

a holding implement having a magnetic bottom surface removably attachable to a support surface, said holding implement further having an arcuate top surface for receiving and maintaining said central body at a substantially stable position; and wherein said each of said first and second light-emitting sections have respective switches that are independently toggled between operable and inoperable positions respectively;

wherein said second light-emitting section further comprises: means for linearly reciprocating said light bulb along a first linear path such that said light bulb selectively oscillates back and forth along a fourth direction based upon a user input wherein said fourth direction is one of substantially parallel or substantially perpendicular to the said second direction.

8. The bi-directional flashlight of claim 7, wherein said linearly reciprocating means comprises:

an elongated rectilinear shaft passing through said casing and having axially opposed ends disposed exterior thereof;

a plurality of turn knobs statically coupled to said shaft ends respectively;

a drum statically coupled to said shaft and medially situated between said knobs, said drum having a curvilinear groove formed therein that travels back and forth along an outer surface of said drum;

a plurality of guide tracks formed within an interior of said casing;

a U-shaped arm brace having a plurality of ends slidably seated within said guide tracks in such a manner that said arm brace is linearly reciprocated along said fourth direction;

a plurality of brackets statically coupled to said arm brace and said light bulb respectively; and a cam rod fixedly anchored to said arm brace and dynamically positioned within said groove such that said cam rod naturally glides along said curvilinear groove and thereby causes said arm brace and said light bulb to linearly reciprocate in sync along said fourth direction when at least one of said knobs are rotated.

9. The bi-directional flashlight of claim 8, wherein said fourth direction is oriented perpendicular to said second direction.

10. The bi-directional flashlight of claim 7, further comprising:

means for selectively biasing said second light-emitting section along a second linear path registered parallel to a longitudinal length of said handle such that said second light-emitting section linearly oscillates back and forth along a fifth direction based upon a user input.

11. The bi-directional flashlight of claim 10, wherein said selectively biasing means comprises:

a dial seated exterior of said casing and having a shaft connected thereto, said shaft being disposed within said casing and having a crank finger protruding outwardly therefrom;

a pivotal drive arm having a linear slot formed at one end thereof and further having a toothed arcuate face formed at an opposing end thereof respectively;

a mobile plate seated within said handle and having a receptacle positioned at a top surface thereof;

a toothed beam statically anchored to a bottom surface of said plate and being in direct engagement with said toothed arcuate face respectively; and a protective cap pivotally coupled to said handle and adjustably positioned over said receptacle for shielding said receptacle from undesirable foreign debris;

said casing being threadably seated within said receptacle and protruding outwardly from said handle;

wherein said cam finger travels back and forth along said slot when said dial is rotated such that said toothed arcuate face selectively engages said toothed beam and thereby linearly reciprocates said plate and said second light-emitting section along said fifth direction.

12. The bi-directional flashlight of claim 11, wherein said fifth direction is registered perpendicular to said fourth direction.

13. A bi-directional flashlight for providing improved illumination, said bi-directional flashlight comprising:

a central body having a handle attached thereto and further having axially opposed first and second ends;

a first light-emitting section permanently attached directly to said first end of said body and facing a first direction away therefrom;

a second light-emitting section removably and selectively attached to said second end of said central body and said handle such that said second light-emitting section selectively faces second and third directions defined parallel and perpendicular to said first direction respectively, said second light-emitting section including a casing and a light bulb positioned within said casing;

a holding implement having a magnetic bottom surface removably attachable to a support surface, said holding implement further having an arcuate top surface for receiving and maintaining said central body at a substantially stable position; and an adjustable strap having a pair of buckles formed at opposed ends thereof for adjusting a length of said strap, said strap being removably attached to said second light-emitting section;

wherein said each of said first and second light-emitting sections have respective switches that are independently toggled between operable and inoperable positions respectively;

wherein said second light-emitting section further comprises: means for linearly reciprocating said light bulb along a first linear path such that said light bulb selectively oscillates back and forth along a fourth direction based upon a user input wherein said fourth direction is one of substantially parallel or substantially perpendicular to the said second direction.

14. The bi-directional flashlight of claim 13, wherein said linearly reciprocating means comprises:

an elongated rectilinear shaft passing through said casing and having axially opposed ends disposed exterior thereof;

a plurality of turn knobs statically coupled to said shaft ends respectively;

a drum statically coupled to said shaft and medially situated between said knobs, said drum having a curvilinear groove formed therein that travels back and forth along an outer surface of said drum;

a plurality of guide tracks formed within an interior of said casing;

a U-shaped arm brace having a plurality of ends slidably seated within said guide tracks in such a manner that said arm brace is linearly reciprocated along said fourth direction;

a plurality of brackets statically coupled to said arm brace and said light bulb respectively; and a cam rod fixedly anchored to said arm brace and dynamically positioned within said groove such that said cam rod naturally glides along said curvilinear groove and thereby causes said arm brace and said light bulb to linearly reciprocate in sync along said fourth direction when at least one of said knobs are rotated.

15. The bi-directional flashlight of claim 14, wherein said fourth direction is oriented perpendicular to said second direction.

16. The bi-directional flashlight of claim 13, further comprising:

means for selectively biasing said second light-emitting section along a second linear path registered parallel to a longitudinal length of said handle such that said second light-emitting section linearly oscillates back and forth along a fifth direction based upon a user input.

17. The bi-directional flashlight of claim 16, wherein said selectively biasing means comprises:

a dial seated exterior of said casing and having a shaft connected thereto, said shaft being disposed within said casing and having a crank finger protruding outwardly therefrom;

a pivotal drive arm having a linear slot formed at one end thereof and further having a toothed arcuate face formed at an opposing end thereof respectively;

a mobile plate seated within said handle and having a receptacle positioned at a top surface thereof;

a toothed beam statically anchored to a bottom surface of said plate and being in direct engagement with said toothed arcuate face respectively; and a protective cap pivotally coupled to said handle and adjustably positioned over said receptacle for shielding said receptacle from undesirable foreign debris;

said casing being threadably seated within said receptacle and protruding outwardly from said handle;

wherein said cam finger travels back and forth along said slot when said dial is rotated such that said toothed arcuate face selectively engages said toothed beam and thereby linearly reciprocates said plate and said second light-emitting section along said fifth direction;

wherein said fifth direction is registered perpendicular to said fourth direction.

* * * * *